US006475272B1

(12) United States Patent
Lopatin

(10) Patent No.: US 6,475,272 B1
(45) Date of Patent: Nov. 5, 2002

(54) CHEMICAL SOLUTION FOR CU-CA-O THIN FILM FORMATIONS ON CU SURFACES

(75) Inventor: Sergey Lopatin, Santa Clara, CA (US)

(73) Assignee: Advanced Micro Devices, Inc., Sunnyvale, CA (US)

( * ) Notice: Subject to any disclaimer, the term of this patent is extended or adjusted under 35 U.S.C. 154(b) by 139 days.

(21) Appl. No.: 09/728,313

(22) Filed: Nov. 30, 2000

(51) Int. Cl.[7] ..... B32B 15/04
(52) U.S. Cl. ..... 106/287.18; 428/471; 438/687
(58) Field of Search ..... 106/287.18; 428/471; 438/687

(56) References Cited

U.S. PATENT DOCUMENTS 5,210,069 A * 5/1993 Chiang et al. ..... 423/593
6,291,348 B1 * 9/2001 Lopatin et al. ..... 438/240

OTHER PUBLICATIONS

Peter Van Zant, Microchip Fabrication: A Practical Guide to Semiconductor Processing, (1997) pp. 392 and 397, 3rd Edition, McGraw–Hill, USA (No Month Provided).

* cited by examiner

*Primary Examiner*—David Brunsman
(74) *Attorney, Agent, or Firm*—LaRiviere, Grubman & Payne, LLP

(57) ABSTRACT

A nontoxic aqueous chemical solution for forming a Cu—Ca—O thin film on a Cu surface. Specifically, the present invention chemical solution is used to form a thin film which reduces electromigration in Cu interconnect lines by decreasing the drift velocity therein which decreases the Cu migration rate in addition to void formation rate. More specifically, the present invention provides a unique chemical solution for forming a copper-calcium-oxide (Cu—Ca—O) thin film on a copper (Cu) surface, comprising: (a) at least one calcium (Ca) ion source for providing a plurality of Ca ions; (b) at least one complexing agent for complexing the plurality of Ca ions; (c) at least one copper (Cu) ion source for providing a plurality of Cu ions; (d) at least one complexing agent for complexing the plurality of Cu ions; (e) at least one pH adjuster; (f) at least one reducing agent for facilitating deposition of the plurality of Cu ions; (g) at least one wetting agent for stabilizing the chemical solution; and (h) a volume of water, (a) through (g) being dissolved in (h). The Cu surface may be immersed in the chemical solution for forming the Cu—Ca—O thin film. By forming the Cu—Ca—O thin film, the present invention improves interconnect reliability, enhances electromigration resistance, and improves corrosion resistance.

19 Claims, 3 Drawing Sheets

CHEMICAL SOLUTION FOR CU-CA-O THIN FILM FORMATIONS ON CU SURFACES

CROSS-REFERENCE TO RELATED APPLICATION(S)

This application is related to concurrently filed and commonly assigned applications (serial numbers to be assigned) entitled:

"Method of Forming Cu—Ca—O Thin Films on Cu Surfaces in a Chemical Solution and Semiconductor Device Thereby Formed;"

"Method of Calcium Doping a Cu Surface Using a Chemical Solution and Semiconductor Device Thereby Formed;"

"Method of Reducing Carbon, Sulphur, and Oxygen Impurities in a Calcium-Doped Cu Surface and Semiconductor Device Thereby Formed;"

"Method of Reducing Electromigration in Copper Lines by Calcium-Doping Copper Surfaces in a Chemical Solution and Semiconductor Device Thereby Formed;" and "Method of Reducing Electromigration in Copper Lines by Forming an Interim Layer of Calcium-Doped Copper Seed Layer in a Chemical Solution and Semiconductor Device Thereby Formed."

TECHNICAL FIELD

The present invention relates to semiconductor devices and their methods of fabrication. More particularly, the present invention relates to the processing of copper interconnect material and the resultant device utilizing the same. Even more particularly, the present invention relates to reducing electromigration in copper interconnect lines by doping their surfaces with barrier material using wet chemical methods.

BACKGROUND OF THE INVENTION

Currently, the semiconductor industry is demanding faster and denser devices (e.g., 0.05-$\mu$m to 0.25-$\mu$m) which implies an ongoing need for low resistance metallization. Such need has sparked research into resistance reduction through the use of barrier metals, stacks, and refractory metals. Despite aluminum's (Al) adequate resistance, other Al properties render it less desirable as a candidate for these higher density devices, especially with respect to its deposition into plug regions having a high aspect ratio cross-sectional area. Thus, research into the use of copper as an interconnect material has been revisited, copper being advantageous as a superior electrical conductor, providing better wettability, providing adequate electromigration resistance, and permitting lower depositional temperatures. The copper (Cu) interconnect material may be deposited by CVD, PECVD, sputtering, electroless plating, and electrolytic plating.

However, some disadvantages of using Cu as an interconnect material include etching problems, corrosion, and diffusion into silicon.[1] These problems have instigated further research into the formulation of barrier materials for preventing electromigration in both Al and Cu interconnect lines.

[1]Peter Van Zant, Microchip Fabrication: A Practical Guide to Semiconductor Processing, 3rd Ed., p. 397 (1997).

In response to electromigration concerns relating to the fabrication of semiconductor devices particularly having aluminum-copper alloy interconnect lines, the industry has been investigating the use of various barrier materials such as titanium-tungsten (TiW) and titanium nitride (TiN) layers as well as refractory metals such as titanum (Ti), tungsten (W), tantalum (Ta), and molybdenum (Mo) and their silicides.[2] Although the foregoing materials are adequate for Al interconnects and Al—Cu alloy interconnects, they have not been entirely effective with respect to all-Cu interconnects. Further, though CVD has been conventionally used for depositing secondary metal(s) on a primary metal interconnect surface, CVD is not a cost-effective method of doping Cu interconnect surfaces with calcium (Ca) ions. Therefore, a need exists for a nontoxic aqueous chemical solution for forming a Cu—Ca—O thin film on a Cu surface in order to improve interconnect reliability, to enhance electromigration resistance, and to improve corrosion resistance.

BRIEF SUMMARY OF THE INVENTION

Accordingly, the present invention provides a nontoxic aqueous chemical solution for forming a Cu—Ca—O thin film on a Cu surface. Specifically, the present invention chemical solution is used to form a thin film which reduces electromigration in Cu interconnect lines by decreasing the drift velocity therein which decreases the Cu migration rate in addition to void formation rate. More specifically, the present invention provides a unique chemical solution for forming a copper-calcium-oxide (Cu—Ca—O) thin film on a copper (Cu) surface, comprising: (a) at least one calcium (Ca) ion source for providing a plurality of Ca ions; (b) at least one complexing agent for complexing the plurality of Ca ions; (c) at least one copper (Cu) ion source for providing a plurality of Cu ions; (d) at least one complexing agent for complexing the plurality of Cu ions; (e) at least one pH adjuster; (f) at least one reducing agent for facilitating deposition of the plurality of Cu ions; (g) at least one wetting agent for stabilizing the chemical solution; and (h) a volume of water, (a) through (g) being dissolved in (h). The Cu surface may be immersed in the chemical solution for forming the Cu—Ca—O thin film. By forming the Cu—Ca—O thin film, the present invention improves interconnect reliability, enhances electromigration resistance, and improves corrosion resistance.

DESCRIPTION OF THE DRAWINGS

For a better understanding of the present invention, reference is made to the below-referenced accompanying drawings.

Reference numbers refer to the same or equivalent parts of the present invention throughout the several figures of the drawings.

DETAILED DESCRIPTION OF THE INVENTION

Figure 1:
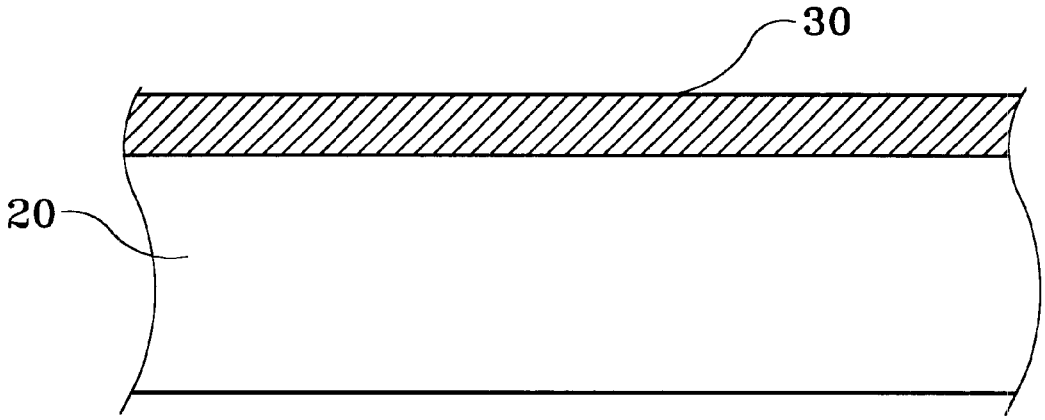
FIG. 1 is a cross-sectional view of a Cu surface having been deposited with a Cu—Ca—O thin film, in accordance with the present invention.

FIG. 1 illustrates, in cross-section, a Cu surface 20 having been deposited with a Cu—Ca—O thin film 30, in accordance with the present invention.

Figure 2:
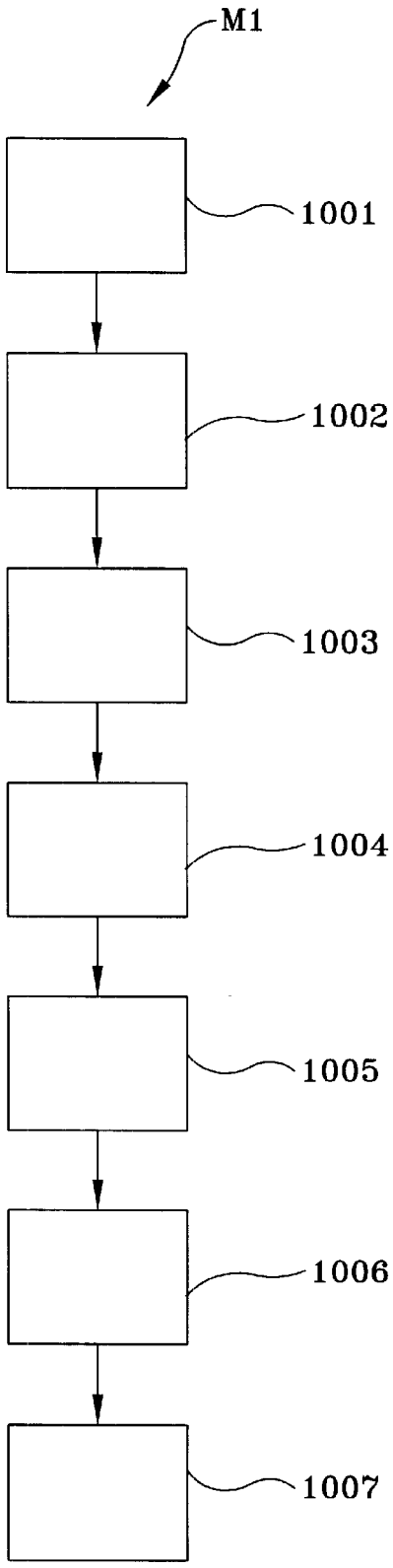
FIG. 2 is a flowchart of a method for synthesizing a unique electroless Cu plating (chemical) solution, in accordance with the present invention.

FIG. 2 illustrates, by flowchart, a method M1 for synthesizing a unique electroless Cu plating (chemical) solution

1000, in accordance with the present invention. The method M1 comprises the steps of: (a) dissolving at least one calcium (Ca) ion source 40 for providing a plurality of Ca ions 45, as indicated by block 1001; (b) dissolving at least one complexing agent 50 for complexing the plurality of Ca ions 45, as indicated by block 1002; (c) dissolving at least one copper (Cu) ion source 60 for providing a plurality of Cu ions 65, as indicated by block 1003; (d) dissolving at least one complexing agent 70 for complexing the plurality of Cu ions 65, as indicated by block 1004; (e) dissolving at least one pH adjuster 80, as indicated by block 1005; (f) dissolving at least one reducing agent 90 for facilitating deposition of the plurality of Cu ions 65, as indicated by block 1006; and (g) dissolving at least one wetting agent 100 for stabilizing the chemical solution, as indicated by block 1007, in a volume of water 110.

Figure 3:
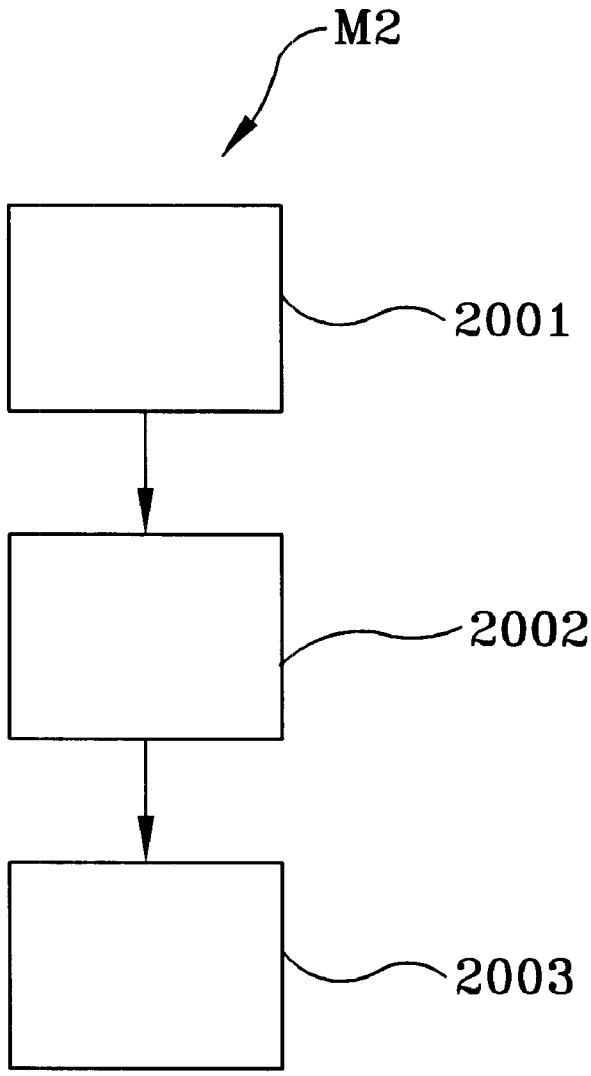
FIG. 3 is a flowchart of a method for forming a Cu—Ca—O thin film on a Cu surface, in accordance with the present invention.

FIG. 3 illustrates, by flowchart, a method M2 for forming a Cu—Ca—O thin film 30 on a Cu surface 20 by treating the Cu surface 20 in a chemical solution 1000, in accordance with the present invention. The method M2 comprises the steps of: (1) providing the chemical solution 1000, the chemical solution 1000 comprising: (a) at least one calcium (Ca) ion source 40 for providing a plurality of Ca ions 45; (b) at least one complexing agent 50 for complexing the plurality of Ca ions 45; (c) at least one copper (Cu) ion source 60 for providing a plurality of Cu ions 65; (d) at least one complexing agent 70 for complexing the plurality of Cu ions 65; (e) at least one pH adjuster 80; (f) at least one reducing agent 90 for facilitating deposition of the plurality of Cu ions 65; (g) at least one wetting agent 100 for stabilizing the chemical solution 1000; and (h) a volume of water 110, (a) through (g) being dissolved in (h), as indicated by block 2001; and (2) treating the Cu surface 20 in the chemical solution 1000, as indicated by block 2002, thereby forming the Cu—Ca—O thin film 30 on the Cu surface 20, as indicated by block 2003.

In addition, the present invention chemical solution may be formulated as follows: wherein the at least one calcium (Ca) ion source comprises calcium carbonate ($CaCO_3$), wherein the at least one complexing agent for complexing the plurality of Ca ions comprises tartaric acid ($HO_2CCH(OH)CH(OH)CO_2H$), wherein the tartaric acid prevents precipitation of the plurality of Ca ions from the chemical solution, wherein the at least one copper (Cu) ion source comprises copper sulfate ($CuSO_4$), wherein the at least one complexing agent for the plurality of Cu ions comprises ethylenediaminetetraacetic acid "EDTA" ($(HO_2CCH_2)_2NCH_2CH_2N(CH_2CO_2H)_2$), wherein the EDTA prevents precipitation of the plurality of Cu ions from the chemical solution, wherein the at least one pH adjuster comprises at least one pH-adjusting compound selected from a group of pH-adjusting compounds consisting essentially of potassium hydroxide (KOH) and tetramethylammonium hydroxide "TMAH"($(CH_3)_4NOH$), wherein the at least one reducing agent for facilitating deposition of the plurality of Cu ions comprises at least one reducing agent compound selected from a group of reducing agent compounds consisting essentially of formaldehyde ($CH_2O$) and glyoxylic acid ($HCOCO_2H$), wherein the at least one wetting agent comprises a surfactant, and wherein the surfactant comprises at least one surfactant selected from a group of surfactants consisting essentially of RE-610™ and Triton™.

In the preferred embodiment of the chemical solution, the composition is formulated with component concentration ranges as follows: wherein the at least one calcium (Ca) ion source is provided in a concentration range of 0.2 g/L–0.4 g/L, wherein the at least one complexing agent for complexing the plurality of Ca ions is provided in a concentration range of 4 g/L–15 g/L, wherein the at least one copper (Cu) ion source is provided in a concentration range of 5 g/L–10 g/L, wherein the at least one complexing agent for complexing the plurality of Cu ions is provided in a concentration range of 10 g/L–20 g/L, wherein the at least one pH adjuster is provided in a concentration range of 20 g/L–25 g/L, wherein the at least one reducing agent is provided in a concentration range of 3 g/L–5 g/L, wherein the at least one wetting agent is provided in a concentration range of 0.01 g/L–0.03 g/L, and wherein the volume of water is provided in a volume range of up to and including 1 L.

Information as herein shown and described in detail is fully capable of attaining the above-described object of the invention, the presently preferred embodiment of the invention, and is, thus, representative of the subject matter which is broadly contemplated by the present invention. The scope of the present invention fully encompasses other embodiments which may become obvious to those skilled in the art, and is to be limited, accordingly, by nothing other than the appended claims, wherein reference to an element in the singular is not intended to mean "one and only one" unless explicitly so stated, but rather "one or more." All structural and functional equivalents to the elements of the above-described preferred embodiment and additional embodiments that are known to those of ordinary skill in the art are hereby expressly incorporated by reference and are intended to be encompassed by the present claims. Moreover, no requirement exists for a device or method to address each and every problem sought to be resolved by the present invention, for such to be encompassed by the present claims. Furthermore, no element, component, or method step in the present disclosure is intended to be dedicated to the public regardless of whether the element, component, or method step is explicitly recited in the claims. However, it should be readily apparent to those of ordinary skill in the art that various changes and modifications in form, semiconductor material, and fabrication material detail may be made without departing from the spirit and scope of the inventions as set forth in the appended claims. No claim herein is to be construed under the provisions of 35 U.S.C. 112, sixth paragraph, unless the element is expressly recited using the phrase "means for."

What is claimed:

1. A chemical solution for forming a copper-calcium-oxide thin film on a copper surface, comprising:

a. at least one calcium ion source for providing a plurality of calcium ions;

b. at least one complexing agent for complexing the plurality of calcium ions;

c. at least one copper ion source for providing a plurality of copper ions;

d. at least one complexing agent for complexing the plurality of copper ions;

e. at least one reducing agent for facilitating deposition of the plurality of copper ions;

f. at least one pH adjuster;

g. at least one wetting agent for stabilizing the chemical solution; and h. a volume of water, the chemical solution being (a) through (g) being dissolved in (h).

2. The chemical solution, as recited in claim 1, wherein the at least one calcium ion source comprises calcium carbonate.

3. The chemical solution, as recited in claim 1, wherein the at least one complexing agent for complexing the plurality of calcium ions comprises tartaric acid, and wherein the tartaric acid prevents precipitation of the plurality of calcium ions from the chemical solution.

4. The chemical solution, as recited in claim 1, wherein the at least one copper ion source comprises copper sulfate.

5. The chemical solution, as recited in claim 1, wherein the at least one complexing agent for the plurality of copper ions comprises ethylenediaminetetraacetic acid, and wherein the ethylenediaminetetraacetic acid prevents precipitation of the plurality of copper ions from the chemical solution.

6. The chemical solution, as recited in claim 1, wherein the at least one pH adjuster comprises at least one pH-adjusting compound selected from a group of pH adjusting compounds consisting essentially of potassium hydroxide and tetramethylammonium hydroxide.

7. The chemical solution, as recited in claim 1, wherein the at least one reducing agent for facilitating deposition of the plurality of copper ions comprises at least one reducing agent compound selected from a group of reducing agent compounds consisting essentially of formaldehyde and glyoxylic acid.

8. The chemical solution, as recited in claim 1, wherein the at least one calcium ion source is provided in a concentration range of 0.2 g/L–0.4 g/L.

9. The chemical solution, as recited in claim 1, wherein the at least one complexing agent for complexing the plurality of calcium ions is provided in a concentration range of 4 g/L–15 g/L.

10. The chemical solution, as recited in claim 1, wherein the at least one copper ion source is provided in a concentration range of 5 g/L–10 g/L.

11. The chemical solution, as recited in claim 1, wherein the at least one complexing agent for complexing the plurality of copper ions is provided in a concentration range of 10 g/L–20 g/L.

12. The chemical solution, as recited in claim 1, wherein the at least one reducing agent is provided in a concentration range of 3 g/L–5 g/L.

13. The chemical solution, as recited in claim 1, wherein the volume of water is provided in a volume range of up to and including 1 L.

14. The chemical solution, as recited in claim 1, wherein the at least one pH adjuster is provided in a concentration range of 20 g/L–25 g/L.

15. The chemical solution, as recited in claim 1, wherein the at least one wetting agent is provided in a concentration range of 0.01 g/L–0.03 g/L.

16. A copper surface being treated in the chemical solution of claim 1, comprising a Cu—Ca—O thin film being formed on the copper surface.

17. A method of forming a copper-calcium-oxide thin film on a copper surface by synthesizing a chemical solution and treating the copper surface in the chemical solution, comprising:

a. providing at least one calcium ion source for providing a plurality of calcium ions;

b. providing at least one complexing agent for complexing the plurality of calcium ions;

c. providing at least one copper ion source for providing a plurality of copper ions;

d. providing at least one complexing agent for complexing the plurality of copper ions;

e. providing at least one reducing agent for facilitating deposition of the plurality of copper ions;

f. providing at least one pH adjuster;

g. providing at least one wetting agent for stabilizing the chemical solution; and h. providing a volume of water;

i. dissolving (a) through (g) in (h), thereby synthesizing the chemical solution; and j. treating the copper surface in the chemical solution, thereby forming the copper-calcium-oxide thin film on the copper surface.

18. The method, as recited in claim 17, wherein the at least one calcium ion source is provided in a concentration range of 0.2 g/L–0.4 g/L, wherein the at least one complexing agent for complexing the plurality of calcium ions is provided in a concentration range of 4 g/L–15 g/L, wherein the at least one copper ion source is provided in a concentration range of 5 g/L–10 g/L, wherein the at least one complexing agent for complexing the plurality of copper ions is provided in a concentration range of 10 g/L–20 g/L, wherein the at least one pH adjuster is provided in a concentration range of 20 g/L–25 g/L, wherein the at least one reducing agent is provided in a concentration range of 3 g/L–5 g/L, wherein the at least one wetting agent is provided in a concentration range of 0.01 g/L–0.03 g/L, and wherein the volume of water is provided in a volume range of up to and including 1 L.

19. A method of synthesizing a chemical solution for forming a copper-calcium-oxide thin film on a copper surface, comprising:

a. providing at least one calcium ion source for providing a plurality of calcium ions;

b. providing at least one complexing agent for complexing the plurality of calcium ions;

c. providing at least one copper ion source for providing a plurality of copper ions;

d. providing at least one complexing agent for complexing the plurality of copper ions;

e. providing at least one reducing agent for facilitating deposition of the plurality of copper ions;

f. providing at least one pH adjuster;

g. providing at least one wetting agent for stabilizing the chemical solution; and h. providing a volume of water;

i. dissolving (a) through (g) in (h), thereby synthesizing the chemical solution.

* * * * *

UNITED STATES PATENT AND TRADEMARK OFFICE

CERTIFICATE OF CORRECTION

PATENT NO. : 6,475,272 B1
DATED : November 5, 2000
INVENTOR(S) : Sergey Lopatin

It is certified that error appears in the above-identified patent and that said Letters Patent is hereby corrected as shown below:

Column 1,
Lines 63 and 64, delete lines and insert lines into Column 2, line 15.

Column 2,
Line 16, insert footnote -- [2] *Id.*, at 392 --.

Signed and Sealed this

Twenty-fourth Day of June, 2003

JAMES E. ROGAN
*Director of the United States Patent and Trademark Office*